US012037795B2

(12) United States Patent
Lin

(10) Patent No.: US 12,037,795 B2
(45) Date of Patent: Jul. 16, 2024

(54) RAILING JOINT

(71) Applicant: Modern Co., Ltd., Guangdong (CN)

(72) Inventor: Chunchih Lin, Dongguan (CN)

(73) Assignee: MODERN CO., LTD., Guangdong (CN)

( * ) Notice: Subject to any disclaimer, the term of this patent is extended or adjusted under 35 U.S.C. 154(b) by 155 days.

(21) Appl. No.: 17/061,097

(22) Filed: Oct. 1, 2020

(65) Prior Publication Data

US 2021/0180328 A1 Jun. 17, 2021

(30) Foreign Application Priority Data

Dec. 12, 2019 (CN) ..... 201922221829.5

(51) Int. Cl.
*E04F 11/18* (2006.01)

(52) U.S. Cl.
CPC ... *E04F 11/1817* (2013.01); *E04F 2011/1821* (2013.01); *E04F 2011/1889* (2013.01)

(58) Field of Classification Search
CPC ..... E04H 17/1439; E04H 17/1452; E04H 17/1488; E04F 11/181; E04F 11/1817; E04F 2011/1819; E04F 2011/1821; E04F 2011/1823; E04F 2011/1825; E04F 2011/1827; F16B 7/0406; F16B 7/0613
See application file for complete search history.

(56) References Cited

U.S. PATENT DOCUMENTS

| | | | | |
|---|---|---|---|---|
| 6,568,658 | B2 * | 5/2003 | Strome | F04F 11/1812 256/65.02 |
| 7,762,533 | B2 * | 7/2010 | DeRogatis | E04F 11/181 256/22 |
| D737,130 | S * | 8/2015 | Carrubba | D8/382 |
| D742,210 | S * | 11/2015 | Carrubba | D8/382 |
| 9,790,689 | B2 * | 10/2017 | Milanowski | E04F 11/1842 |
| 10,060,136 | B2 * | 8/2018 | Milanowski | E04F 11/1817 |
| 10,316,523 | B2 * | 6/2019 | Yu | E04F 11/1817 |
| 10,604,941 | B2 * | 3/2020 | Schneider | E04F 11/1836 |
| 2006/0107613 | A1 * | 5/2006 | Chung | E04F 11/1853 52/832 |
| 2009/0272957 | A1 * | 11/2009 | Nelson | E04F 11/1834 256/65.01 |
| 2011/0248232 | A1 * | 10/2011 | Leary | E04F 11/1817 256/65.01 |

(Continued)

FOREIGN PATENT DOCUMENTS

| | | | | |
|---|---|---|---|---|
| CA | 2340600 | A1 * | 9/2002 | E04F 11/181 |
| DE | 19522224 | A1 * | 8/1996 | B60N 3/026 |
| DE | 20001350 | U1 * | 4/2000 | E04F 11/181 |

(Continued)

*Primary Examiner* — Jonathan P Masinick
(74) *Attorney, Agent, or Firm* — Arch & Lake LLP

(57) ABSTRACT

A railing joint is provided. The railing joint is used for connecting a baluster to a rail, and the railing joint is capable of being inserted into an inner cavity of the baluster. The railing joint includes a main body and a washer. The main body includes a groove and a first joint, the first joint is provided with a first reinforcing rib, the first reinforcing rib is capable of abutting against an inner wall of the baluster, and one end of the main body is connected to the rail. The washer is sleeved in the groove and capable of abutting against the inner wall of the baluster in a sealed manner.

9 Claims, 4 Drawing Sheets

(56) References Cited

U.S. PATENT DOCUMENTS

2016/0281752 A1* 9/2016 Koller ..... F16B 2/04

FOREIGN PATENT DOCUMENTS

| | | | | |
|---|---|---|---|---|
| DE | 10003168 | A1 * | 7/2001 | ..... E04F 11/1834 |
| DE | 10331925 | A1 * | 2/2005 | ..... E04F 11/108 |
| EP | 2003265 | A2 * | 12/2008 | ..... E04F 11/1817 |
| FR | 2250877 | A1 * | 6/1975 | |
| KR | 101852576 | B1 * | 4/2018 | |

* cited by examiner

RAILING JOINT

CROSS-REFERENCE TO RELATED APPLICATIONS

The present application claims the benefit of Chinese Patent Application No. 201922221829.5, filed on Dec. 12, 2019, the entire content of which is hereby incorporated by reference for all purposes.

TECHNICAL FIELD

The present application relates to the technical field of guardrail equipment, and in particular to a railing joint.

BACKGROUND

At present, as people pay more and more attention to safety and protection, balusters are widely used in buildings with height differences, such as indoor and outdoor stairs or platforms, to prevent the danger of falling. Balusters are generally made of metal pipes. Although metal pipes have a longer service life than wooden structures, the mounting and construction process is cumbersome.

In order to achieve fast mounting, when a baluster is assembled, the position of the baluster is usually pre-marked on the rail and a mounting hole is opened, and then the baluster is aligned with and fitted into the mounting hole and fixed.

However, due to the existence of error, the internal diameters, wall thickness and roundness of the balusters made of metal pipes are different, which makes the gap between the baluster and the mounting hole too large or too small when the baluster is mounted. If the gap between the baluster and the mounting hole is too large, noise will be caused due to shaking and collision with the rail after the baluster is mounted, and it is easy for water vapor and dirt to enter the baluster along the gap, causing corrosion inside the baluster, reducing the thickness and service life of the baluster, and reducing the safety of the baluster. If the gap between the baluster and the mounting hole is too small, it will be difficult for the baluster to be mounted into the mounting hole. Mounting the baluster with a force will damage the baluster, damage the surface of an anti-rust layer, and cause rust at a break. In addition, after the circular metal baluster is mounted into the rail, due to a hard contact between the baluster and the rail, and as the service time is delayed, the circular baluster is easy to rotate, reducing the reliability and safety of the baluster.

SUMMARY

An object of the present application is to provide a railing joint. The railing joint is capable of sealing an inner cavity of a baluster, which is beneficial for moisture resistance and rust prevention of the inner cavity of the baluster, vibration reduction, and noise reduction, and can prevent the baluster from rotating, which is beneficial for improving reliability and safety of the baluster.

To achieve the object, the present application adopts the technical solutions described below.

The railing joint configured to connect the baluster to a rail includes: a main body and a washer.

The main body includes a groove and a first joint, where the first joint is provided with a first reinforcing rib, the first reinforcing rib is capable of abutting against an inner wall of the baluster, and one end of the main body is connected to the rail.

A washer is sleeved in the groove and capable of abutting against the inner wall of the baluster in a sealed manner.

Preferably, a convex rib is provided in the groove, and the washer is capable of being sleeved on the convex rib.

Preferably, the main body further includes a second joint, and the groove is disposed between the first joint and the second joint.

Preferably, the second joint is provided with a second reinforcing rib, and the second reinforcing rib is capable of abutting against the inner wall of the baluster.

Preferably, the second reinforcing rib is provided with a chamfer to facilitate insertion of the main body into the baluster through the chamfer.

Preferably, the second reinforcing rib and the first reinforcing rib are staggered.

Preferably, the washer is a soft washer.

Preferably, the main body further includes a first end surface and a second end surface disposed opposite to each other, the main body is provided with a screw hole, the screw hole communicates with the first end surface and the second end surface, and the main body connects the first end surface to the rail through a screw.

Preferably, the first end surface is provided with a reinforcing groove for reinforcing strength at the first end surface and increasing expandability of the main body.

Preferably, the reinforcing groove is an annular groove, and the annular groove is wound around an outer side of the screw hole.

The beneficial effects of the present application is described below.

The present application provides a railing joint for connecting a baluster to a rail. The railing joint includes a main body and a washer, the main body includes a groove and a first joint, the first joint is provided with a first reinforcement rib, and when the railing joint is inserted into an inner cavity of the baluster, the first reinforcing rib can abut against an inner wall of the baluster, so that the stability of a structure of the baluster is increased since the inner wall is abutted against by the railing joint; in addition, the washer is sleeved in the groove and abuts against the inner wall of the baluster in a sealed manner when the railing joint is inserted into the inner cavity of the baluster, thereby sealing the inner cavity of the baluster, achieving moisture resistance and rust prevention of the inner cavity of the baluster, preventing the baluster from being artificially twisted or rotating on its own axis, avoiding the rotation of the baluster, improving the reliability and safety of the baluster, and extending the service life of the baluster.

Figure 1:
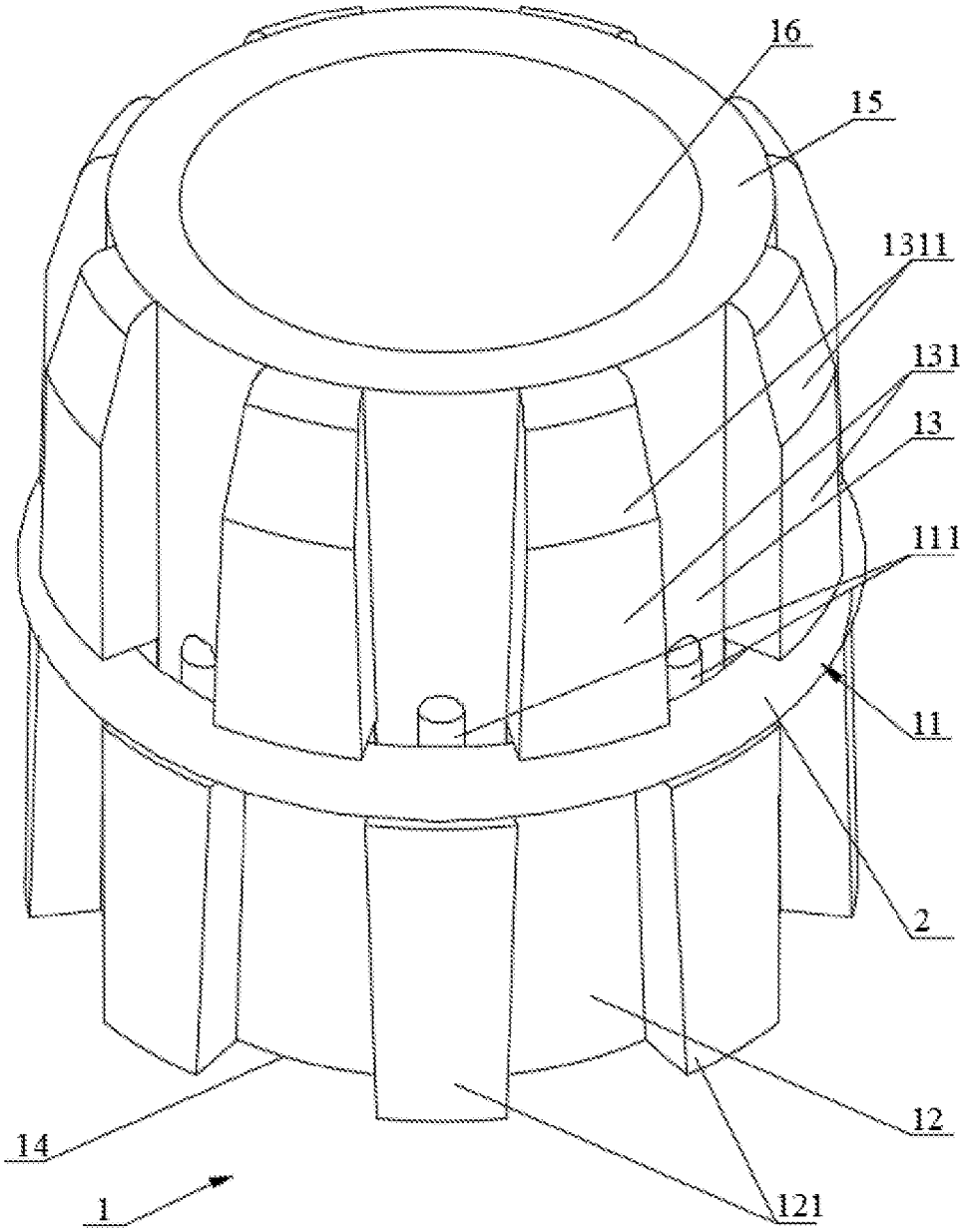
FIG. 1 is a perspective view of a railing joint according to a specific embodiment of the present application.

In the drawings: 1. Main body; 11. Groove; 111. Convex rib; 12. First joint; 121. First reinforcing rib; 13. Second joint; 131. Second reinforcing rib; 1311. Chamfer; 14. First end face; 141. Reinforcing groove; 15. Second end face; 16. Screw hole; 2. Washer; 100. Baluster; 101. Rail; 102. Screw.

DETAILED DESCRIPTION

In order to solve technical problems presented in prior art, the technical solutions of the embodiments of the present application will be further described in detail below in combination with the drawings. Apparently, the described embodiments are merely a part, not all, of the embodiments of the present application. Based on the embodiments of the present application, all other embodiments obtained by those skilled in the art without making creative work fall in the scope of protection of the present application.

In the description of the present application, unless otherwise expressly specified and limited, the terms "couple," "connect," and "fix" should be understood in a broad sense, for example, as fixed connection, detachable connection, or integral connection; as mechanical connection or electrical connection; as direct connection or indirect connection through an intermediate medium; and as communication inside two elements or interaction between two elements. For those of ordinary skill in the art, the specific meanings of the above terms in the present application may be understood in specific cases.

In the present application, unless otherwise expressly specified and limited, when a first feature is described as "on" or "below" a second feature, the first feature and the second feature may be in direct contact, or be in contract via another feature between the two features instead of being in direct contact. Moreover, when the first feature is described as "on", "above" or "over" the second feature, the first feature is right on, above or over the second feature or the first feature is obliquely on, above or over the second feature, or the first feature is simply at a higher level than the second feature. When the first feature is described as "below", "under" or "underneath" the second feature, the first feature is right below, under or underneath the second feature or the first feature is obliquely below, under or underneath the second feature, or the first feature is simply at a lower level than the second feature.

The technical solutions of the present application will be further described below with reference to the drawings and specific embodiments.

The present application provides a railing joint. The railing joint can be inserted into an inner cavity of a baluster 100 and is used for connecting the baluster 100 to a rail 101. As shown in FIG. 1, the railing joint includes a main body 1 and a washer 2. One end of the main body 1 can be connected to the rail 101. The main body 1 includes a groove 11 and a first joint 12. The groove 11 is disposed on one end of the first joint 12, and the first joint 12 is provided with a first reinforcing rib 121. When the railing joint is inserted into the inner cavity of the baluster 100, the first reinforcing rib 121 is capable of abutting against an inner wall of the baluster 100. The washer 2 is sleeved inside the groove 11, and when the railing joint is inserted into the inner cavity of the baluster 100, the washer 2 is capable of abutting against the inner wall of the baluster 100 in a sealed manner. Preferably, a plurality of first reinforcing ribs 121 is provided, and the plurality of first reinforcing ribs 121 are evenly spaced on a side surface of the first joint 12, so that the first reinforcing ribs 121 abut against the inner wall of the baluster 100 evenly, and the railing joint can be prevented from deflection in the inner cavity of the baluster 100.

In this embodiment, the first reinforcing rib 121 is capable of abutting against the inner wall of the baluster 100, which can not only avoid the noise due to the baluster 100 shaking and colliding with the rail 101 after the baluster 100 is mounted, but also prevent the baluster 100 from rotating on its own axis due to the fact that the inner wall is abutted against by the railing joint, which can effectively prevent the baluster 100 from rotating on its own axis and is conducive to improving the safety of the baluster 100. In addition, the washer 2 is capable of abutting against the inner wall of the baluster 100 in a sealed manner, thereby sealing the inner cavity of the baluster 100, avoiding a gap between the inner wall of the baluster 100 and the railing joint, preventing water vapor and organic substances from entering a hollow tube under the conditions of outdoor sun, wind and rain, and preventing the inside of the baluster 100 from rusting, which is conducive to preventing a thickness of the baluster 100 from thinning due to the corrosion of the baluster 100, improving the reliability of the baluster 100 and extending the service life of the baluster 100.

Preferably, the main body 1 is made of a plastic material, so that the main body 1 has a certain elastic deformation, and when the railing joint is inserted into the inner cavity of the baluster 100 and the first reinforcing rib 121 abuts against the inner wall of the baluster 100, the occurrence of hard contact on the inner wall of the baluster 100 can be avoided, which can not only prevent the first reinforcing rib 121 from colliding with the inner wall of the baluster 100 and damaging the baluster 100, but also enable the first reinforcing rib 121 to always abut against the inner wall of the baluster by using the elastic restoring force of the first reinforcing rib itself, and not only prevent the baluster 100 from being artificially twisted or rotating on its own axis, but also help to reduce the vibration and noise of the baluster 100. More preferably, a soft washer is used as the washer 2, such as a rubber washer, so that when the railing joint is inserted into the inner cavity of the baluster 100 and the washer 2 abuts against the inner wall of the baluster 100, the washer 2 will be elastically deformed and can use its own elastic restoring force to always abut against the inner wall of the baluster 100, which not only can ensure that the washer 2 can seal the inner cavity of the baluster 100, that water vapor and debris can be prevented from entering the inner cavity of the baluster 100, and that the moisture resistance and rust prevention of the inner cavity of the baluster 100 are achieved, but also can prevent the baluster 100 from being artificially twisted or rotating on its own axis, which is conducive to improving the reliability and safety of the baluster and extending the service life of the baluster. In this embodiment, the washer 2 is an O-shaped washer, which not only makes it easy for the washer 2 to be sleeved in the groove 11, but also facilitates insertion of the main body 1 sleeved with the washer 2 into the inner cavity of the baluster 100. It can be understood that the material, shape, and size of the washer 2 can be selected by those skilled in the art according to actual situations to ensure that the washer 2 can seal the inner cavity of the baluster 100.

Figure 2:
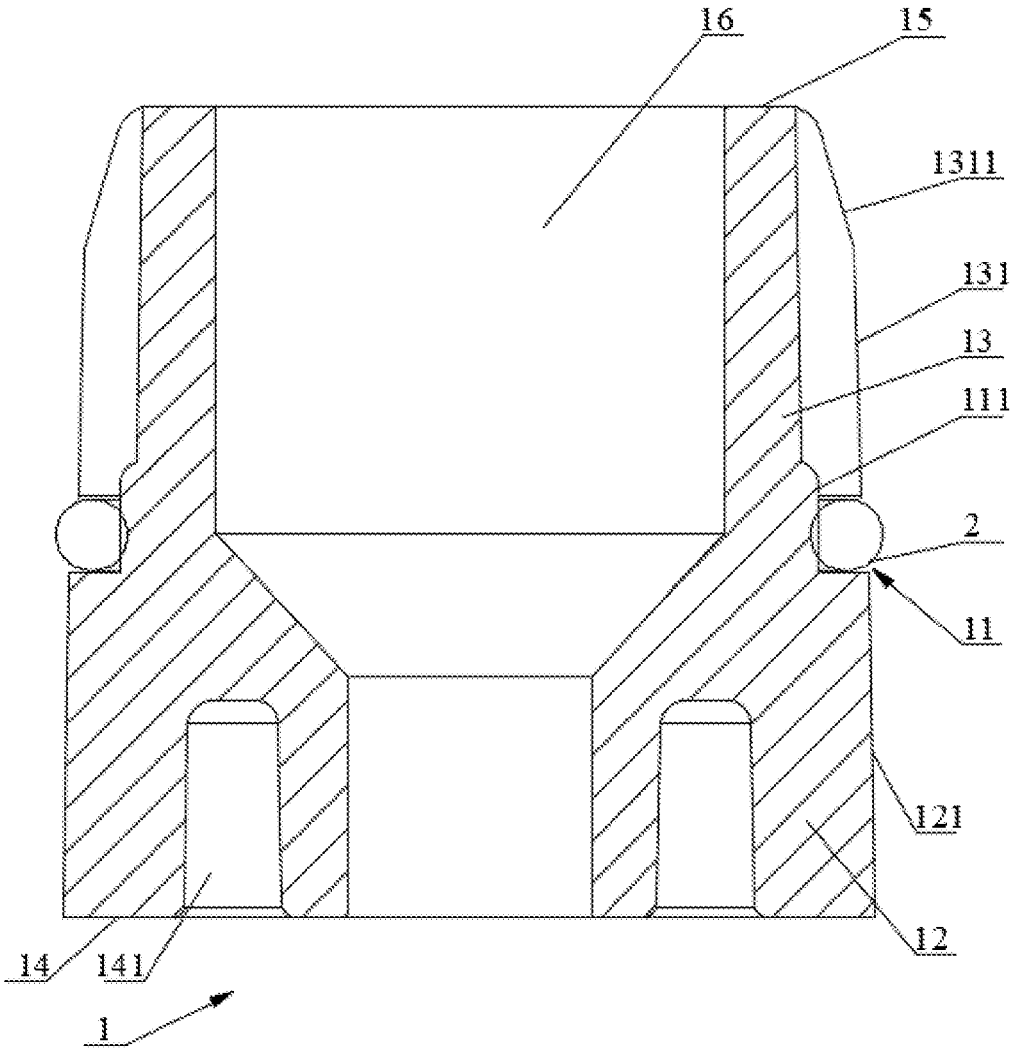
FIG. 2 is a sectional view of a railing joint according to a specific embodiment of the present application.
Figure 3:
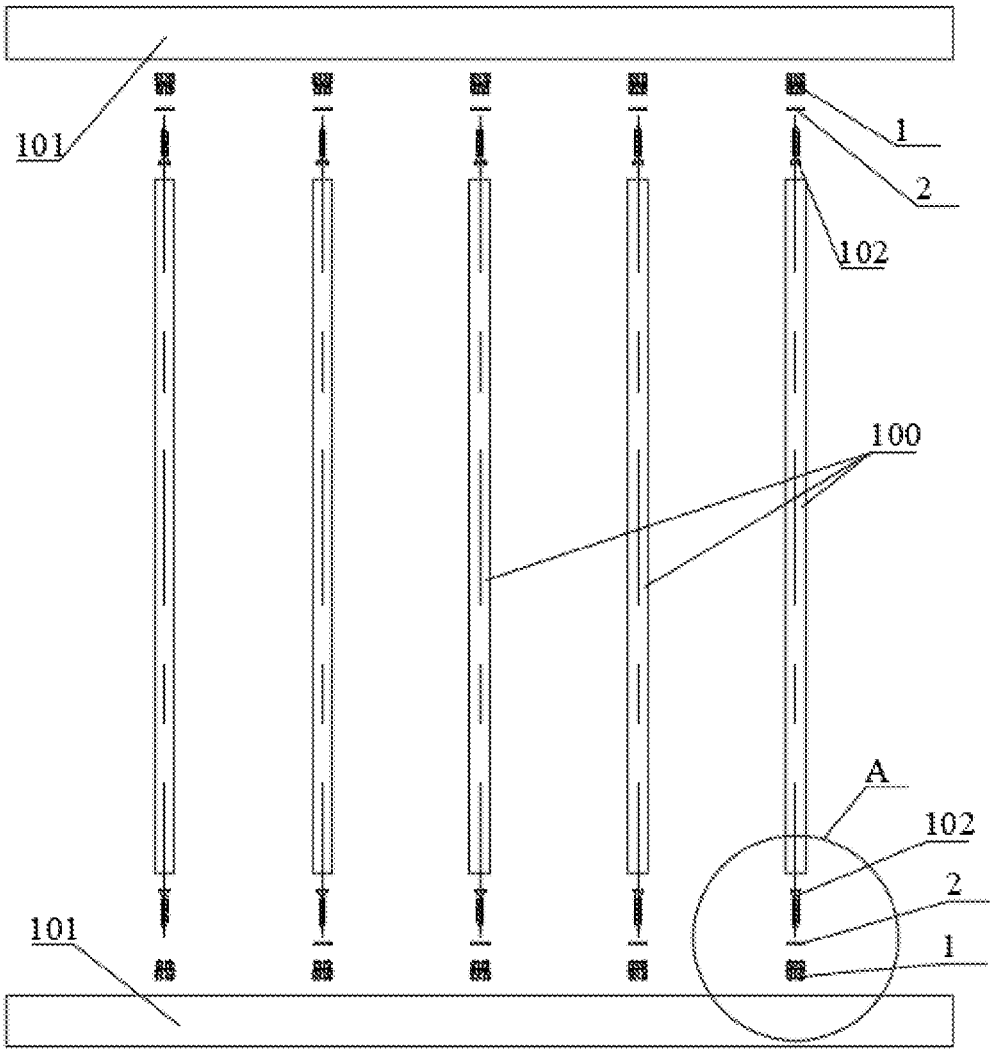
FIG. 3 is a mounting view of a railing joint according to a specific embodiment of the present application.
Figure 4:
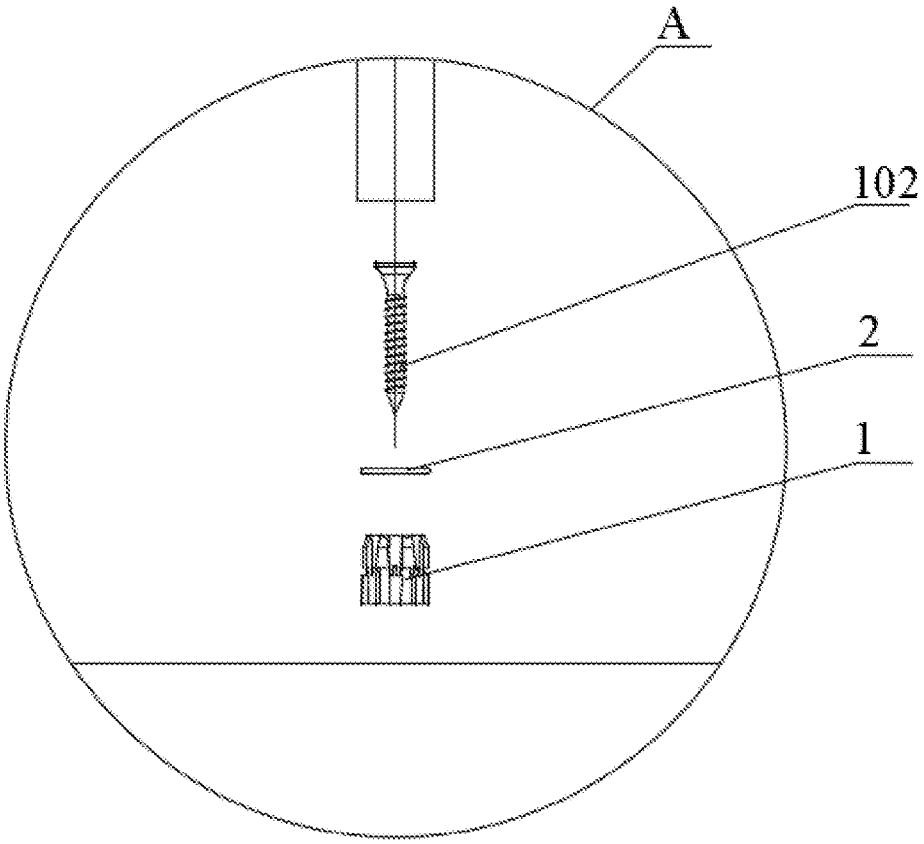
FIG. 4 is an enlarged view of FIG. 3 at A.

In this embodiment, the main body 1 is provided with a screw hole 16, and the main body 1 is connected to the rail 101 by a screw 102, so that one end of the main body 1 is connected to the rail 101. Preferably, the main body 1 includes a first end surface 14 and a second end surface 15 disposed opposite to each other, and the screw hole 16 passes through the first end surface 14 and the second end surface 15, so that the screw 102 can penetrate the whole main body 1 when passing through the screw hole 16, and then the first end surface 14 is connected to the rail 101, and the whole main body 1 is connected to the rail 101, which is conducive to improving the connection strength of the railing joint and the rail 101. A mounting view of the railing joint is as shown in FIGS. 3 and 4. It can be understood that the first end surface 14 can also be connected to the rail 101 by an adhesive, and those skilled in the art can make a selection according to the actual situations. As shown in FIG. 2, more preferably, the first end surface 14 is provided with a reinforcing groove 141, which can reinforce the structural strength of the first end surface 14 and prevent the first end surface 14 from being damaged from extrusion when the first end surface 14 is connected to the rail 101, and it is convenient to add other structures or components to the reinforcing groove 141 in the future, so as to increase the expandability of the main body 1. Further, the reinforcing groove 141 is provided as an annular groove, the annular groove is wound around the outer side of the screw hole 16, and the center line of the annular groove is disposed to coincide with the center line of the screw hole 16, so that the processing of the annular groove and the screw hole 16 is convenient, which is conducive to reducing the production cost.

In this embodiment, a convex rib 111 is disposed in the groove 11 of the main body 1, and the washer 2 is sleeved on the convex rib 111, which is conductive to enabling the washer 2 to be hooped on the groove 11, so that the washer 2 is not easy to fall off after being sleeved on the convex rib 111. The convex rib 111 can also expand the inner diameter of the washer 2, which is conductive to enabling the washer 2 to better abut against the inner wall of the baluster 100 and can ensure the strength of abutment of the washer 2 against the inner wall of the baluster 100.

Preferably, the main body 1 further includes a second joint 13, and the groove 11 is disposed between the first joint 12 and the second joint 13, so that when the washer 2 is sleeved in the groove 11, the first joint 12 and the second joint 13 located on two sides of the groove 11 can play a positioning role on the washer 2, which is beneficial for preventing the washer 2 from falling out of the groove 11. In this embodiment, the second joint 13 is provided with a second reinforcing rib 131, and the second reinforcing rib 131 can also abut against the inner wall of the baluster 100, which is beneficial for avoiding noise generation due to the baluster 100 shaking and colliding with the rail 101 after the baluster 100 is connected to the rail 101, and which further makes the baluster 100 not rotate on its own axis due to the fact that the inner wall of the baluster 100 is abutted against by the railing joint. The rotation of the baluster 100 can be effectively avoided, and the safety of the baluster 100 is improved. Preferably, in this embodiment, the second reinforcing rib 131 and the first reinforcing rib 121 are disposed in a staggered arrangement, which is not only beneficial for greatly reducing the production cost of the railing joint, but also for improving the overall structural strength of the railing joint and extending the service life of the railing joint. More preferably, the second reinforcing rib 131 is provided with a chamfer 1311, so that the railing joint can be smoothly inserted into the inner cavity of the baluster 100 through the chamfer 1311, and then the connection between the railing joint and the baluster 100 is convenient and quick.

Apparently, the embodiments of the present application described above are merely examples for clearly explaining the present application, and are not intended to limit the embodiments of the present application. For those of ordinary skill in the art, various apparent changes, adaptations and substitutions can be made without departing from the scope of protection of the present application. Embodiments of the present application cannot be and do not need to be exhausted herein. Any modification, equivalent substitution, improvement and the like made within the spirit and principle of the present application shall fall in the protection scope of the claims of the present application.

What is claimed is:

1. A railing joint configured to connect a baluster to a rail and be capable of being inserted into an inner cavity of the baluster, and comprising:

a main body comprising a groove and a first joint, wherein the first joint is provided with a first reinforcing rib, the first reinforcing rib is capable of abutting against an inner wall of the baluster, and one end of the main body is connected to the rail;

a washer sleeved in the groove and capable of abutting against the inner wall of the baluster in a sealed manner; and a convex rib is provided in the groove, and the washer is capable of being sleeved on the convex rib.

2. The railing joint of claim 1, wherein the main body further comprises a second joint, and the groove is disposed between the first joint and the second joint.

3. The railing joint of claim 2, wherein the second joint is provided with a second reinforcing rib, and the second reinforcing rib is capable of abutting against the inner wall of the baluster.

4. The railing joint of claim 3, wherein the second reinforcing rib is provided with a chamfer to facilitate insertion of the main body into the baluster through the chamfer.

5. The railing joint of claim 3, wherein the second reinforcing rib and the first reinforcing rib are staggered.

6. The railing joint of claim 1, wherein the washer is a soft washer.

7. The railing joint of claim 1, wherein the main body further comprises a first end surface and a second end surface disposed opposite to each other, the main body is provided with a screw hole, the screw hole communicates with the first end surface and the second end surface, and the main body connects the first end surface to the rail through a screw.

8. The railing joint of claim 7, wherein the first end surface is provided with a reinforcing groove for reinforcing strength at the first end surface and increasing expandability of the main body.

9. The railing joint of claim 8, wherein the reinforcing groove is an annular groove, and the annular groove is wound around an outer side of the screw hole.

* * * * *